US005099997A

United States Patent [19]

Ooms et al.

[11] Patent Number: 5,099,997

[45] Date of Patent: Mar. 31, 1992

[54] PACKAGE FOR DISPENSING A FLUID CONTAINING AN INK

[75] Inventors: Willem Ooms, Oegstgees, Netherlands; Frank R. Moss, Jr., Cookeville; James A. McCowan, Monterey, both of Tenn.

[73] Assignee: Porelon, Inc., Cookeville, Tenn.

[21] Appl. No.: 427,883

[22] Filed: Oct. 27, 1989

[51] Int. Cl.[5] ..... B65D 73/00

[52] U.S. Cl. ..... 206/484; 206/81; 206/1.9; 206/575; 251/52

[58] Field of Search ..... 206/1.7, 1.9, 81, 484, 206/575, 632, 524.2; 101/363, 364; 251/51, 52

[56] References Cited

U.S. PATENT DOCUMENTS

| | | | |
|---|---|---|---|
| 2,777,824 | 1/1957 | Leeds | 521/52 |
| 3,424,300 | 1/1969 | Penniman, Jr. | 206/1.9 |
| 3,580,390 | 5/1971 | Shull, Jr. | 206/1.9 |
| 3,589,288 | 6/1971 | Lake | 101/363 |
| 3,913,734 | 10/1975 | Siegel | 206/484 |
| 3,967,728 | 7/1976 | Gordon et al. | 206/484 |
| 4,007,838 | 2/1977 | Awad | 206/484 |
| 4,092,922 | 6/1978 | Schweitzer | 101/363 |
| 4,382,513 | 5/1983 | Schirmer et al. | 206/484 |
| 4,537,308 | 8/1985 | Hollander, Jr. | 206/219 |
| 4,539,793 | 9/1985 | Malek | 206/632 |
| 4,696,404 | 9/1987 | Corella | 206/632 |
| 4,768,437 | 9/1988 | Piepmeier, Jr. et al. | 521/51 |
| 4,872,556 | 10/1989 | Farmer | 206/632 |
| 4,890,744 | 1/1990 | Lane, Jr. et al. | 206/632 |

*Primary Examiner*—David T. Fidei
*Attorney, Agent, or Firm*—Foley & Lardner

[57] ABSTRACT

A premix capable of forming a microporous marking structure is prepared by kneading a pouch containing the premix, then opening the pouch and removing the premix therefrom. The mixed premix is then typically poured in a mold, and an absorbent backing layer is placed on the premix. The premix is then heated to form a microporous structure, and then cooled. The dispensing package used in this method is a thin-walled, flexible pouch which contains the premix. This dispensing pouch can eliminate the need to make up a batch of premix immediately prior to casting, together with the need to measure the amount of premix needed for each casting.

11 Claims, 2 Drawing Sheets

PACKAGE FOR DISPENSING A FLUID CONTAINING AN INK

FIELD OF THE INVENTION

This invention relates to a method for making structures for applying marking fluids, including structures for use in marking devices, such as hand stamps. The invention further relates to a dispensing package useful in such a method.

BACKGROUND OF THE INVENTION

Leeds U.S. Pat. Nos. 2,777,824 and 3,055,297 disclose marking structures made of highly porous plastic material, the pores of which are of microscopic proportions and are filled with a marking fluid such as an ink. Structures made in accordance with the teaching of the Leeds patents have experienced a high degree of commercial success as hand stamps, stamp pads, and also ink rolls such as are used for applying ink to printing members in automatic printing equipment. Such structures are advantageous because of their long life, both in length of time and in numbers of operations or impressions, and because they operate well without the necessity of repetitive re-inking of the marking surface. Such structures apply ink in a uniform and reliable fashion. For example, hand stamps including plates made using such structures, which have various characters or designs molded at their surface, provide sharp and uniform impressions with high definition and uniformity. As stamp pads, such structures place a uniform layer of ink on a marking device, such as a rubber stamp, and are reliable over long periods of time. Similarly, as ink rolls, such structures provide uniform inking of printing members and exhibit fast recovery to facilitate repetitive use over long periods of time.

Known methods of making marking structures generally involve an initial step of making a mold having indentations or cavities corresponding to a relief pattern to appear on the finished marking structure. The mold is made of a material which can partially absorb marking fluid from the finished marking structure. Since it is necessary to use an excess amount of marking fluid in order to make the marking structure, the mold is often made from an absorbent material to remove the excess ink from the marking structure as it cures in the mold. In the alternative, a layer of absorbent material, such as sized felt, has been placed over the microporous marking structure in order to absorb excess ink, allowing a non-absorbent mold to be employed.

A premix containing a thermoplastic resin and a marking fluid, such as an ink, is then placed in the mold to fill the indentations and form a layer of premix therein. A mixer and dispenser are used to prepare a batch of premix. Often some of the premix is wasted because the entire batch is not needed, and substantial time and investment in equipment is required in order to prepare the premix for use.

The resulting premix-filled mold is then placed in a press, and subjected to heat and pressure sufficient to form the ink-impregnated microporous structure which is suitable for making a self-inking (self-replenishing) hand stamp. The open-celled, skinless nature of the microporous structure allows a small but generally constant flow of ink from the marking structure. Thus, as ink is removed from the surface of the relief pattern on the marking structure when an impression is made, ink from the interior of the marking structure flows to the surface in sufficient quantity to allow formation of further images having substantially the same brightness and clarity as the initial image.

Other methods are known for forming plastisol mixtures into ink-dispensing articles. In one such method, a flexible foam material is prepared in the absence of the ink. See, for example, Fujimura U.S. Pat. No. 4,306,498, issued Dec. 21, 1981.

The method of the invention utilizes a flexible dispensing pouch for marking fluids such as ink or premix. Pouches containing fluid materials are known, but in unrelated fields such as food dispensing. For example, small flexible packages of catsup and mustard are in wide use. The present invention provides a method for making microporous marking structures which eliminates some of the disadvantages of known methods, particularly as to preparation of the premix.

SUMMARY OF THE INVENTION

The method of the present invention involves preparing a premix capable of forming a microporous marking structure by kneading a pouch containing the premix, then opening the pouch and removing the premix therefrom. The mixed premix is then typically poured in a mold, and an absorbent backing layer is placed on the premix. The premix is then heated to form a microporous structure therefrom, and then cooled.

According to a further aspect of the invention, the premix contains a thermoplastic resin and an ink which does not dissolve the resin. A predetermined amount of this premix is filled into the mouth of a flexible pouch, which mouth is then closed and sealed. The resulting packaged premix can be used to make microporous marking structures without making up a large batch of premix using conventional mixing and dispensing apparatus.

A dispensing package according to an additional aspect of the invention includes a thin-walled, flexible pouch which contains a marking fluid such as an ink. The marking fluid may be an ink, so that the dispensing package can be used to re-ink an ink roll, or a premix for use in forming a microporous marking structure. These and other aspects of the invention are set forth in detail hereafter.

BRIEF DESCRIPTION OF THE DRAWING

The invention will be further described with reference to the appended drawing, wherein like numerals denote like elements, and.

DETAILED DESCRIPTION OF PREFERRED EMBODIMENTS

The present invention advantageously utilizes a fluid premix material which can be used to form an ink-impregnated microporous marking structure for a hank stamp. As used herein, the term "microporous" means having an open-celled network of small interstices or voids both at the surface of a piece of material and throughout the interior thereof, i.e. remote from its surface. The material has pores small enough to prevent substantial bleed-out (leakage) of a marking fluid, i.e. small enough as to be not normally discernible by the naked eye, yet large enough to permit some flow therein of a marking fluid such as an ink as described hereinafter. For example, a material having an average pore size of less than about 100 microns in diameter and greater than about 0.5 microns in diameter functions well as a marking structure, although any properly selected pore size or distribution relative to the viscosity and ability of the fluid to wet the material may be suitably selected by those skilled in the art.

Figure 1:
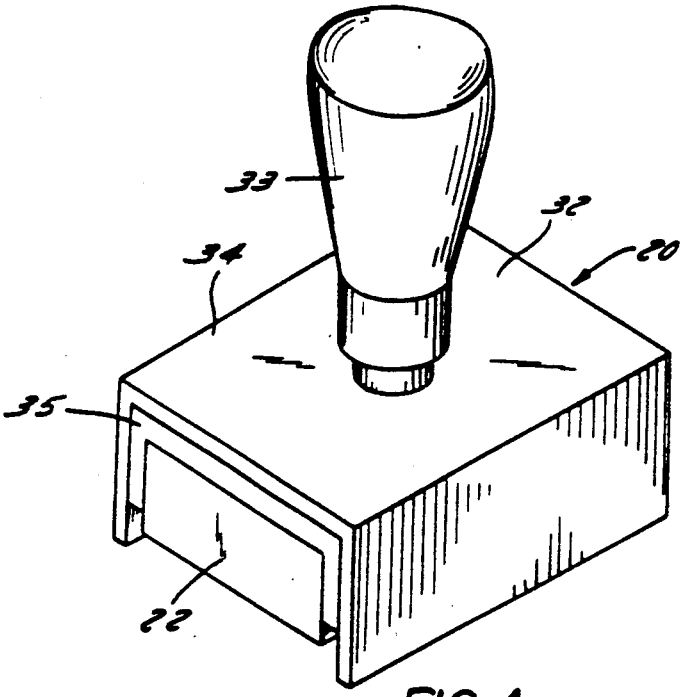
FIG. 1 is a perspective view of a hand stamp having a marking structure of this invention.
Figure 2:
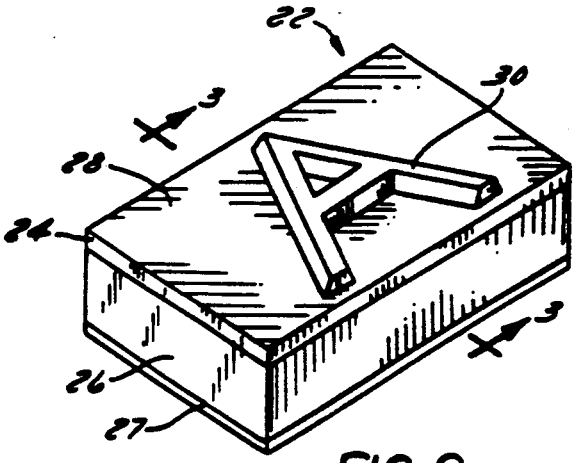
FIG. 2 is an inverted perspective view of the marking structure portion of FIG. 1.

FIG. 1 illustrates a hand stamp 20 having a marking structure 22 made according to the method of the invention. As shown in FIG. 2, marking structure 22 is a block structure having three successive layers including an outer, ink-impregnated, microporous layer 24, an absorbent backing layer 26 and a sealant layer 27. Ink-impregnated layer 24 contains an ink which is applied, through a relief portion 30 (e.g. characters) to a marking surface such as a piece of paper. Marking structure 22 is attached to a hand stamp mount 32.

Hand stamp mount 32 generally includes a plastic elongated handle 33 oriented perpendicularly to the imaginary plane defined by the surface of relief portion 30 of ink-impregnated layer 24, which handle 33 is slidably interlocked with an outer, generally though/-shaped or rectilinear frame 34 which covers at least the top and sides of marking structure 22. Handle 33 is secured for unison movement with an inner, generally trough-shaped or rectilinear frame 35 of smaller dimensions than outer frame 34. Sealant layer 27 of marking structure 22 is secured by suitable means, such as a layer of adhesive, directly to the inner surface of inner frame 35. Sealant layer 27 provides a surface for the adhesive to bind to and prevents absorbed ink from penetrating to the adhesive, possibly causing marking structure 22 to become separated from mount 32. One suitable sealant is a plastisol or polyvinyl chloride in methyl ethyl ketone. In the prior art, such a sealant layer was applied directly to the rear face of the microporous structure and that approach may successfully be adopted here.

Handle 33, inner frame 35 and marking structure 22 are generally biased by suitable resilient means, e.g. a spring (not shown), to an upward position so that hand stamp 20 may rest on a table top or similar surface with marking structure 20 in a raised, non-printing position. The user grasps hand stamp 20 by handle 33, positions it over a surface to be marked and presses down to pring an image. Outer frame 34 allows the user to brace the stamp against the surface to be marked. Absorbent layer 26 does not impair the functioning of the finished hand stamp.

Figure 3:
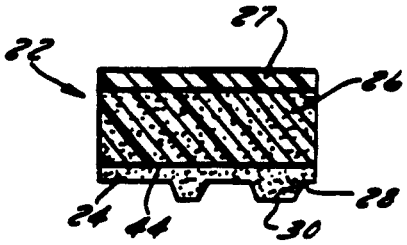
FIG. 3 is a sectional view of the marking structure of FIG. 2, taken along the line 3—3 as indicated in FIG. 2.

FIG. 3 shows a cross-section of marking structure 22. Ink-impregnated layer 24 has a front surface 28 and relief portion (character) 30 which is integrally connected with, and made of the same material as, surface 28. Ink-impregnated layer 24 is connected to backing layer 26 at an interface zone 44. Although the interface is shown as a sharp line of demarcation, the interface actually is a zone along the lower portion of backing layer 26. A portion of ink-impregnated layer 24, including both resin and ink, may be absorbed into backing layer 26 to form interface zone 44. This bonds outer layer 24 and backing layer 26 together and allows excess ink from layer 24 to flow into backing layer 26 during the short stabilization period rather than out of surface 28. Unless backing layer 26 is bonded to ink-impregnated layer 24, the resulting laminate may not hold together during subsequent processing and, thus, this approach improves manufacturing integrity.

A premix used to make marking structure 22 may be prepared as follows. A thermoplastic resin powder, such as polyvinyl chloride powder, which will pass through a 75 mesh screen, is blended with a plasticizer, such as liquid dioctyl phthalate, forming a plastisol blend. A marking fluid such as ink, separately prepared from dyes, pigments, dye solvents and vehicles which are substantially incompatible with the resin, is added to the plastisol blend, preferably in a weight ratio of marking fluid to plastisol blend within the range of about 0.1–1.0. The resulting mixture is referred to as the premix herein.

The intended end use and quality of the marking structure of this invention will tend to determine the needed amount of marking fluid. If the ink-plastisol ratio is below about 0.1, there will be little or no application of marking fluid on the surface of intended application. Above a ratio of 1.0 the strength and structural integrity of the outer layer are lessened (perhaps catastrophically depending upon the exact ratio and composition of components) and there may be a tendency to "bleed out" marking fluid even when the marking structure is not being used. If a very light impression or disposition of marking fluid is intended, the ratio of marking fluid to thermoplastic resin can be fairly low. On the other hand, if a heavy impression or deposition of marking fluid is intended, the ratio of marking fluid to thermoplastic resin should be fairly high. A preferred range for the ratio of ink to thermoplastic resin for the ink-impregnated layer is in the range of about 0.3–0.7. Within this range, a strong impression may be applied and strength of the material is good.

Figure 4:
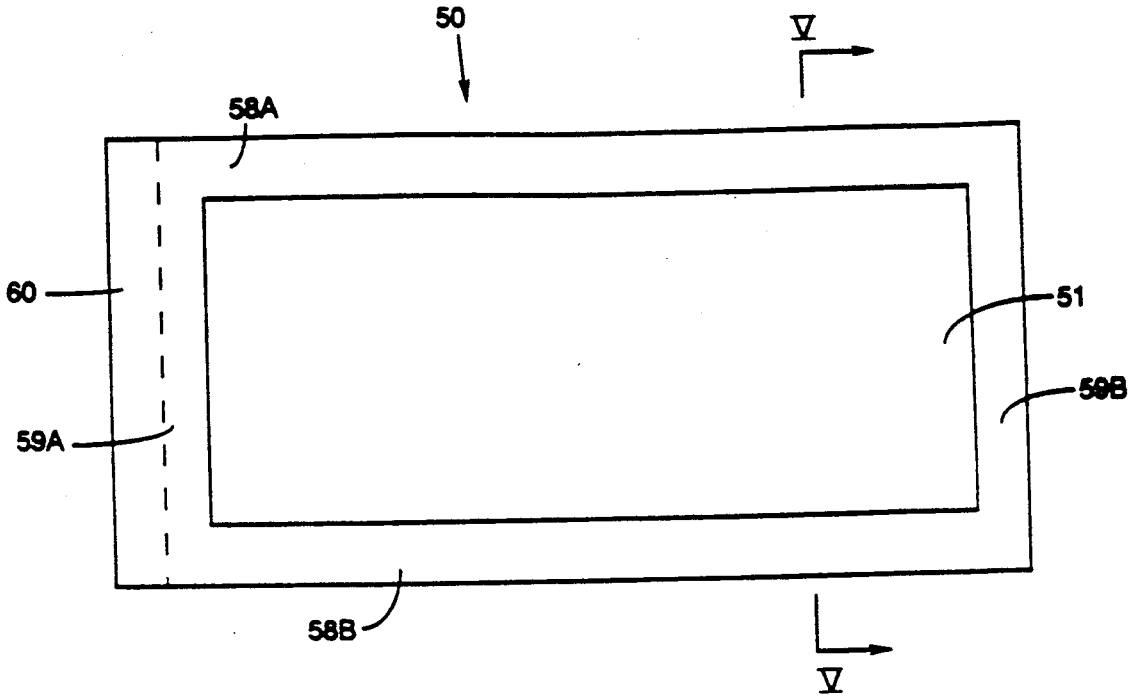
FIG. 4 is a perspective view of a dispensing package according to the invention.
Figure 5:
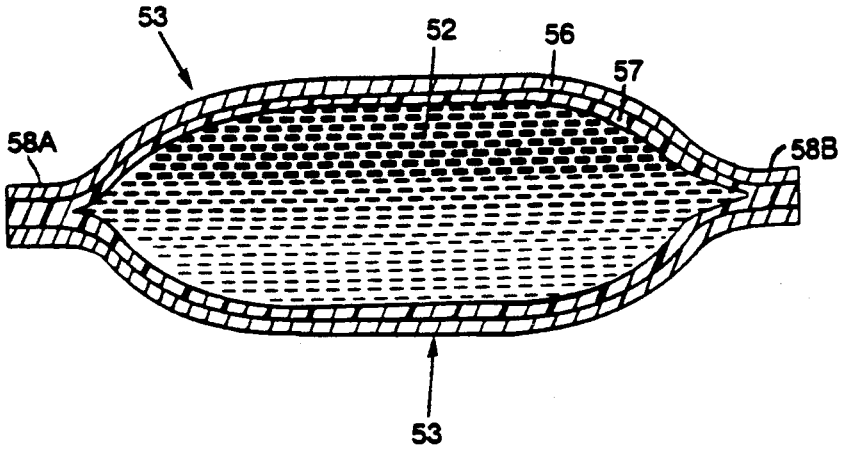
FIG. 5 is a cross-sectional view taken along the line V—V in FIG. 4.

Referring to FIGS. 4 and 5, a dispensing package 50 according to the invention includes a thinwalled, flexible pouch 51 containing a fluid premix 52. Pouch 51 comprises a pair of sheets 53 each comprising an outer layer 56 of thin (e.g., 1–3 mil) aluminum foil and an inner layer 57 of a plastic material such as polyethylene, PVC, mylar, or the like. Plastic layers 57 are heat-bonded together along side and end edges 58A, 58B, and 59A, 59B, respectively. Prior to filling of pouch 51, enlarged end edge 59A is left unsealed to provide a mouth 60 through which pouch 51 can be filled with premix 52. After filling, edge 59A is then heat-bonded in the same manner as the other edges to seal pouch 51. Instructions (not shown) for use of dispensing package 50 may be conveniently printed on one side of pouch 51.

Pouch 51 should be free of leakage, and the amount of air inside pouch 51 should be minimized to ensure that the pouch will contain the proper predetermined amount of premix 52. This amount conveniently is the precise amount needed to fill a casting mold. Different sized pouches can be mass-produced for use with various standart mold sizes. More generally, pouch 51 may be made from a wide variety of commercially available materials so long as it is sufficiently flexible to permit the premix within to be manually mixed by kneading prior to use and/or squeezed from the pouch by manual pressure on the sides of the pouch. Such materials must, of course, also resist being dissolved, decomposed, saturated, etc. with the premix.

It has been found that conventional inks used in hand stamp premix tend to penetrate (bleed through) conventional heat-bondable thermoplastics over time. On the other hand, materials such as metallic foil, nylon, and the like which can resist the premix are not readily heat-bondable. Thus, according to a preferred embodiment of the invention, the pouch is double-walled, including an inner, hear-bondable plastic layer and an outer, ink-impermeable layer. In particular, it appears that the plasticizer used in the premix tends to soften typical heat-bondable plastics such as polyethylene, allowing the ink to penetrate. Thus, the outer layer should be resistant to the effects of conventional plasticizers.

Package 50 can eliminate the need to make up a batch of premix immediately prior to casting, together with the need to measure the amount of premix needed for each casting. Package 50 also permits the preparation of microporous marking structures, e.g., hand stamps, without the need for expensive mixing and dispensing equipment.

The dispensing package according to the invention can also be used for dispensing precise amounts of marking fluids other than premixes. For example, an ink of the type used in ink rolls can be used in place of premix 52. Ink-dispensing rolls are commonly used to re-ink ribbons in printers and similar devices. See, for example, Piepmeier Jr. et al. U.S. Pat. No. 4,768,437, issued Sept. 6, 1988, the entire contents of which are hereby incorporated herein by reference. The inks used in such ink rolls commonly contain a plasticizer.

According to a further aspect of the invention, a user can re-ink a depleted ink-dispensing roll by opening a dispensing package according to the invention and squeezing the ink therefrom onto an ink-impregnated material, such as an ink roll as described in the foregoing patent to Piepmeier et al. In the alternative, the ink-impregnated roll may be placed in the pouch to absorb the ink therein, and then removed when reinking is completed. This permits a premeasured amount of ink to be applied to the ink material, e.g., the ink roll, to extend its useful life.

Materials suitable for forming the backing layer 26 include wool (woven or felted), cotton (woven or felted), urethane foam, polyvinyl chloride (PVC) foam, jute, hemp, cork, non-woven cellulose (including paper and cardboard), and fabrics of treated synthetic fibers (woven or non-woven) such as polyethylene, polypropylene, nylon, rayon, polyester, teflon, and fiberglass. Suitable urethane foams must be of the open cell type with interconnected pores to allow for fluid transfer.

Backing layer 26 is preferably a felt of at least 75% wool, preferably 95% wool. Wool absorbs the premix in a superior fashion. The felt should have a density within the range of from about 12 to 20 pounds per square yard for felts having a nominal thickness of one inch, hereafter referred to as "nominal square yard." Suitable felts include wool felt covered by ASTM standard specification D2475-77, and particularly those classified 12R, 16R, 16S, 18R and 20S. The preferred felt has a density of 14 to 18 pounds per nominal square yard.

Backing layer 26 preferably has a thickness at least about equal to the thickness of ink-impregnated layer 24. Preferred thicknesses range from 0.075 to 0.335 inches. The preferred thickness for use in hand stamps is 0.1 to 0.15 inches. The thickness of the backing material, in general, is preferably sufficient to absorb at least 0.30 to 0.70 grams of marking fluid per square inch of back layer, particularly 0.40 to 0.50 gm/in$^2$. Excessive absorption will shorten stamp life, while insufficient absorption can cause ink leakage.

A mold in the size and shape of the desired marking structure, having the desired design (e.g. characters) engraved in its surface, is used to form the marking structure. The premix within the pouch is preheated if necessary to being it to at least room temperature, and then kneaded to obtain a uniform mixture. The pouch is then opened, e.g., cut open with a scissors. Premix from the package is poured from the dispensing package into the mold to a total depth approximately twice the thickness of the mold cavities used for forming characters. The backing layer is then placed in the mold on top of the premix. A cover plate is tightly secured to the mold to enclose the materials in a sealed, restricted space. The mold is preferably non-absorbent to the premix, i.e. does not absorb any marking fluid or resin. Molds made of impermeable phenol-formaldehyde resin are suitable for this purpose. A mold having an array of different messages or designs thereon for forming multiple hand stamps, called a matrix board, is conveniently used to improve productivity.

The mold or matrix board is then heated to a high temperature, normally within the range of about 110°–150° C. for a sufficient period to form the microporous layer (plate), normally about 5–50 minutes, depending primarily upon the size and shape of the marking structure being produced and the type of thermoplastic resin being used. During this molding process, the premix used to form the outer, ink-impregnated layer is partly absorbed into the backing layer to form the interface zone 44 of the two layers. The aggregates of the ink-impregnated layer define a network of pores which is partially filled with the ink. As the premix is heated, it is preferably subjected to uniform pressure of at least about 0.5 ton for not less than about 5 minutes, preferably at least 10 minutes. The pressure aids formation of the microporous structure and enhances bonding of the backing and microporous structure.

The backing layer absorbs excess ink from the ink-impregnated layer and allows molding to be carried out on a non-absorbent mold. The molds currently used industry wide must have some absorbency to accomodate the excess marking fluid that is present during molding. Normally, if the mold has too little or too much absorbency, as determined by the particular formula of premix being used, the finished marking structure can be affected adversely, i.e. either has too much marking fluid left in it to be removed after molding, or has too little marking fluid and correspondingly reduced performance. The backing layer eliminates problems encountered in practice with molds having inadequate ink absorption properties.

The marking structure is cooled to room temperature within the sealed mold, either by placing such sealed mold in an environment cooled below room temperature, such as by circulating cold fluids around the mold, or simply by allowing the mold to stand at room temperature for a period of time. The marking structure is then removed from the mold and is ready for mounting to a suitable holder such as hand stamp mount 32 shown in FIG. 1. The marking structure is then ready for use. The described process eliminates the need for a lengthy waiting period, e.g. a step wherein excess ink slowly leaks from the ink-impregnated layer, as well as the need for elaborate preparation of the premix.

A wide variety of thermoplastic resins, particularly synthetic resins, are acceptable for use in the premix.

Resins which fuse at a temperature below the boiling point of the marking fluid which is used therewith should be used. Examples of acceptable thermoplastic resins are: polyvinyl chloride, polyvinyl acetate, polyvinylidene chloride, polyvinyl butyral, cellulose acetate butyrate, polymethyl methacrylate, polymethyl acrylate, polysulfone, and copolymers and combinations thereof. Highly preferred resins include: polyvinyl chloride, polyvinyl acetate, polyvinylidene chloride, polyvinyl acetate, polyvinylidene chloride, copolymers of vinyl chloride and other ethylenically unsaturated monomers, and combinations thereof. The most preferred resins are copolymers of vinyl chloride and vinyl acetate.

A plasticizer is used in the premix in an amount of about 40 to 160 percent by weight of the resin. The plasticizer should soften the resin to allow the formation of aggregates which form the marking sturctures of the invention. Examples of suitable plasticizers for use with polyvinyl chloride, polyvinyl acetate, polyvinylidene chloride, copolymers of vinyl chloride and other ethylenically unsaturated monomers, or combinations thereof, include tricresylphosphate, dioctyl phthalate, dimethyl phthalate, dibutyl phthalate, butyl benzyl phthalate, trioctyl phosphate. Other acceptable plasticizers for use with specific thermoplastic resins are well-known. The aforementioned Leeds patents list plasticizers useful with a wide variety of thermoplastic resins, many of which are suitable for use in this invention. The contents of Leeds U.S. Pat. Nos. 2,777,824 and 3,055,297 are expressly incorporated by reference herein. The use of plasticizers facilitates the formation of interconnected aggregates of thermoplastic resin. The aggregates of thermoplastic resin are sintered, that is, joined by heat, to form a cohesive structure.

The marking fluid used in this invention, in addition to being suitable for the intended purpose, must be incompatible with (non-solvent to) the thermoplastic resin used in the sense that such fluids must not substantially soften or dissolve such resins. A wide variety of known marking fluids are acceptable. Inks are normally prepared from dyes, pigments, and dye solvents and vehicles. Such solvents and vehicles must not readily dissolve the resins. Examples include aliphatic hydrocarbons, castor oil esters, ethanolamides, fatty acids, fatty acid esters, glyceryl esters, glycols, glycol esters, marine oils, mineral oils, polyethylene and polypropylene glycols, and vegetable oils. Dyes are generally used in such inks in amounts of from about 5–25 percent of total ink weight. The dyes, of course, must be soluble in the dye solvent used. Color pigments are normally dispersed in the vehicles used in amount of from about 2–20 percent of total ink weight. Particle sizes of the pigments must be small enough to pass through the micropores of the marking structure.

Suitable marking fluids and methods for preparing such fluids are known in the art, and form no part of this invention. The term "marking fluid" refers to inks of various kinds and also to other fluids which can be applied in like manner, that is, by contact of the microporous layer with the surface of intended application.

It will be understood that the above description is of preferred exemplary embodiments of the invention, and that the invention is not limited to the specific forms shown. Modifications may be made in the described methods and products without departing from the scope of the invention as expressed in the appended claims. The invention is further described in the following examples, wherein Example 1 describes preparation of a dispensing package according to the invention, and Example 2 describes the preparation of a hand stamp according to the invention.

EXAMPLE 1

A premix is first prepared by the following procedure. A preblend is prepared by adding 283.5 pounds of linoleic acid to a container and heating to 175° to 185° F., followed by adding 141.5 pounds of ester gum from CDI Dispersions. The mixture is agitated with heating to 200° to 210° F. The preblend is then cooled to 150° F. for use.

A mixing vessel is charged with 26.1 pounds of a 75% solution of 2,4,7,9-tetramethyl-5-decyne-4,7-diol in 25% ethylene glycol, 26.1 pounds of dioctyl phthalate, 87 pounds of butyl benzyl phthalate, 43.5 pounds of a copolymer of vinyl chloride and vinyl acetate and 217.5 pounds of a copolymer of vinyl chloride and vinyl acetate. A vacuum of 27 inches of mercury is applied to the mixture, and it is agitated for 25 minutes at low speed. At this point, 52.5 pounds of dioctyl phthalate is added along with 17.4 pounds of Interstab BC-103 (a mixture containing about 18% of nonaromatic hydrocarbon solvent, about 5% of an aromatic hydrocarbon solvent, a barium monocarboxylic acid salt such that the composition as a whole contains less than 10% barium, a zinc monocarboxylic acid salt such that the composition as a whole contains less than 1% zinc, and a cadmium salt of monocarboxylic acid such that the composition as a whole contains less than 5% cadmium), 6% mixed glycol ethers, 25% alkyl aryl phosphite and 7% alcohol, together with 139.2 pounds of the preblend prepared above. The resulting mixture is mixed under vacuum for 10 minutes. At this time 261 pounds of a blue ink made from 1,5-pentanediol, pentaerythritol monoricinoleate, Victoria Pure Blue BO blue dye, and castor oil is added and the mixture is agitated under vacuum.

The resulting premix is then poured into a rectangular, polyethylene-lined, flexible aluminum pouch which is sealed on three sides by heat-bonding of the plastic liner. The open side (mouth) of the pouch is then sealed by heat bonding after 42 grams of premix has been filled into the pouch. The pouch is then stored until needed.

EXAMPLE 2

To make a handstamp using the premix-filled pouch, the pouch prepared in Example 1 is first prewarmed to at least room temperature prior to use. The premix is then mixed by kneading the pouch by hand for about one minute, and then opened. A negative matrix board having a desired relief pattern is prepared using known methods such as the hot lead technique or photopolymer pattern plates. The matrix board is then placed into a 4"×6" mold. About 12 g of premix is squeezed from the pouch and applied over the matrix board. The premix is carefully rubbed into the mold cavities to force out air and eliminate pin holes. The mold is then filled with an additional 30 g of premix from the pouch to a total fill of about 42 g. A piece of ⅛" 16Rl felt, as a backing layer, is placed over the premix within the mold.

The top of the mold is then placed over the absorbent backing layer and the entire mold is placed into a press which has been preheated to 125° C. The press is then closed and a force of 5 tons is applied for 15 minutes. At the end of the above time, the pressure is released and the mold is removed from the press and allowed to cool to room temperature. The mold is disassembled and the casting is peeled away from the plate. The casting is then cut into individual pieces for use as hand stamps and applied to conventional hand stamp mounts using an appropriate adhesive. It is preferred to seal the back of the backing layer with suitable sealers such as EC821 available from 3 M Company, so that the plastic of the hand stamp frame may be bonded securely to the surface of the backing layer, and ink absorbed by the backing layer cannot contact the adhesive used to bond the hand stamp mount to the marking structure.

We claim:

1. A premix supply package, comprising:

a closed, flexible, kneadable pouch which is impervious to ink; and a predetermined amount of a premix containing a thermoplastic resin and an ink which is a non-solvent to said resin disposed within said pouch, wherein said premix consists essentially of said ink and a plastisol containing said resin and 40 to 160 wt. % of a plasticizer based on the weight of said resin, and the weight ratio of said ink to said plastisol is in the range of 0.1 to 1.0.

2. The package of claim 1, wherein said pouch comprises a pair of sheets of a thin, flexible material bonded together along the outer periphery thereof.

3. The package of claim 2, wherein said premix further comprises a plasticizer.

4. A premix supply package, comprising:

a closed, flexible, kneadable pouch which is impervious to ink, which pouch comprises a pair of sheets of a thin flexible material bonded together along the outer periphery thereof, wherein each of said sheets comprises an inner, heat-bondable layer and an outer layer made of a plasticizer-resistant material; and a predetermined amount of a premix containing a thermoplastic resin and a plasticizer, wherein said resin is selected from the group consisting of polyvinyl chloride, polyvinyl acetate, polyvinylidene chloride, copolymers of vinyl chloride and other ethylenically unsaturated monomers, and combinations thereof, and an ink which is a non-solvent to said resin disposed within said pouch.

5. The package of claim 4, wherein said resin is a copolymer of vinyl chloride and vinyl acetate.

6. The package of claim 2, wherein said layers comprise a pair of plastic sheets heat-bonded at mutual superposed edges thereof.

7. The package of claim 3, wherein each of said sheets comprises a inner, heat-bondable plastic layer and an outer layer made of a plasticizer-resistant material.

8. The package of claim 1, wherein said resin is selected from the group consisting of polyvinyl chloride, polyvinyl acetate, polyvinylidene chloride, copolymers of vinyl chloride and other ethylenically unsaturated monomers, and combinations thereof, and said plasticizer is selected from the group consisting of tricresylphosphate, dioctyl phthalate, dimethyl phthalate, dibutyl phthalate, butyl benzyl phthalate, and trioctyl phosphate.

9. The package of claim 8, wherein said pouch comprises a pair of thin, flexible sheets bonded together along the outer periphery thereof, and each of said sheets comprises an inner, heat-bondable plastic layer and an outer layer made of a plasticizer-resistant material.

10. The package of claim 9, wherein said outer layers comprise 1 to 3 mil thick aluminum foil and said inner layers comprise polyethylene, mylar, or PVC.

11. The package of claim 1, wherein the amount of said premix is predetermined to correspond to an amount needed to fill a mold for forming a microporous marking structure.

* * * * *